US010344477B2

(12) United States Patent
Levinton

(10) Patent No.: US 10,344,477 B2
(45) Date of Patent: Jul. 9, 2019

(54) WEIGHT-REDUCING DISCS, SPECIALLY DESIGNED MESHES AND THE METHOD THAT INCLUDES THE AFORESAID, FOR PRODUCING WEIGHT-REDUCED STRUCTURE SUCH AS SLABS, PRE-SLABS, FLOORS, PARTITIONS AND BEAMS

(71) Applicant: Ricardo Horacio Levinton, Buenos Aires (AR)

(72) Inventor: Ricardo Horacio Levinton, Buenos Aires (AR)

(73) Assignee: Ricardo Horacio Levinton, Buenos Aires (AR)

( * ) Notice: Subject to any disclaimer, the term of this patent is extended or adjusted under 35 U.S.C. 154(b) by 225 days.

(21) Appl. No.: 15/287,422

(22) Filed: Oct. 6, 2016

(65) Prior Publication Data

US 2017/0058518 A1 Mar. 2, 2017

Related U.S. Application Data

(63) Continuation-in-part of application No. 13/501,038, filed as application No. PCT/CL2010/000036 on Sep. 10, 2010, now abandoned.

(51) Int. Cl.
*E04C 2/04* (2006.01)
*E04B 5/32* (2006.01)
(Continued)

(52) U.S. Cl.
CPC ..... *E04C 2/044* (2013.01); *E04B 5/328* (2013.01); *E04C 2/06* (2013.01); *E04C 5/064* (2013.01); *E04C 5/162* (2013.01)

(58) Field of Classification Search
CPC ..... E04C 2/044; E04C 5/064; E04C 5/162; E04C 2/26; E04C 5/04; E04C 5/20;
(Continued)

(56) References Cited

U.S. PATENT DOCUMENTS 1,388,544 A 8/1921 Benedict
3,213,581 A 10/1965 Macchi
(Continued)

FOREIGN PATENT DOCUMENTS

AR 065606 A1 6/2009
AR 091251 A1 1/2015
(Continued)

OTHER PUBLICATIONS

European Patent Office, Extended European Search Report in European Patent No. 10825916.9, dated Sep. 12, 2012, 6 pp.
(Continued)

*Primary Examiner* — Beth A Stephan
(74) *Attorney, Agent, or Firm* — Leydig, Voit & Mayer, Ltd.

(57) ABSTRACT

This invention refers to a weight-lightening disc for making light reinforced concrete structures such as slabs, prefabricated slabs, foundation slabs, partition walls and beams; to a mesh, specifically designed for this invention and to the construction method to make such structures. The method allows manufacturing the components that make it possible to construct buildings with light reinforced concrete structures. The field of application of the invention is construction in general, such as houses, buildings and bridges.
The invention provides a solution to the problem of lightening of the structures, including a construction method that comprises a set of weight-lightening discs in combination with electro-welded meshes (specially designed for the each specific thickness of the slab) and the hooks that hold together the meshes.
The compound of elements and the method allow lightening minimum-thickness slabs.

8 Claims, 8 Drawing Sheets

(51) Int. Cl.
*E04C 5/06* (2006.01)
*E04C 5/16* (2006.01)
*E04C 2/06* (2006.01)

(58) Field of Classification Search
CPC ... E04C 5/16; E04B 5/328; E04B 5/32; E04B 5/16; E04B 5/43
See application file for complete search history.

(56) References Cited

U.S. PATENT DOCUMENTS

| | | | | |
|---|---|---|---|---|
| 4,702,048 | A | 10/1987 | Millman | |
| 2005/0138877 | A1 * | 6/2005 | Inoue | B28B 23/0068 52/414 |
| 2007/0186506 | A1 * | 8/2007 | Haag | B28B 23/0068 52/742.14 |
| 2009/0165420 | A1 | 7/2009 | Pfeffer et al. | |
| 2012/0200004 | A1 | 8/2012 | Levinton | |

FOREIGN PATENT DOCUMENTS

| | | | | |
|---|---|---|---|---|
| AR | 096834 | A1 | 2/2016 | |
| AR | 096873 | A1 | 2/2016 | |
| BO | 11659 | | 10/2016 | |
| BR | PI0900044 | A2 * | 8/2011 | |
| BR | 102015004315-5 | | 8/2017 | |
| CL | 839-2015 | | 12/2016 | |
| DE | 19903304 | A1 | 8/2000 | |
| EP | 1624128 | A1 | 2/2006 | |
| EP | 2474677 | B1 | 11/2013 | |
| FR | 2466580 | A1 | 4/1981 | |
| JP | 09250196 | A * | 9/1997 | E04B 5/326 |
| JP | 2005-282010 | A | 10/2005 | |
| JP | 2009-191542 | A | 8/2009 | |
| KR | 10-0778072 | B1 | 11/2007 | |
| KR | 10-0899339 | B1 | 5/2009 | |
| NL | 7500735 | A | 7/1976 | |
| PE | 000258515 | | 11/2015 | |
| WO | 92-06253 | A1 | 4/1992 | |

OTHER PUBLICATIONS

Spanish Patent Office, International Search Report in International Patent Application No. PCT/CL2010/000036, dated May 31, 2011, 8 pp.

Spanish Patent Office, Written Opinion in International Patent Application No. PCT/CL2010/000036, dated May 31, 2011, 13 pp.

* cited by examiner

WEIGHT-REDUCING DISCS, SPECIALLY DESIGNED MESHES AND THE METHOD THAT INCLUDES THE AFORESAID, FOR PRODUCING WEIGHT-REDUCED STRUCTURE SUCH AS SLABS, PRE-SLABS, FLOORS, PARTITIONS AND BEAMS

A reinforced concrete structure comprising weight-lightening discs for making light reinforced concrete structures such as slabs, pre-slabs, floors, partitions and beams, comprising an upper and lower mesh suitable designed for this invention, and to the construction method of these structures. The method allows manufacturing the components that make it possible to construct buildings with light-weight reinforced concrete structures. The scope of the invention is construction in general, preferably the construction of houses, buildings and bridges.

The main technical problem this invention gives is a solution to lighten the structures of buildings in order to save material and simplify the construction process. Lifting heavy materials to heights requires physical effort and man hours and implies accident risks exposure for the workers, consumption of energy and other economic costs. By using the invention, the mass of slabs is reduced by 30 to 35%, that is to say, less concrete is needed, consequently saving up to 35% of such material. By pumping the concrete from the ground level, the material to be lifted in this process is much reduced.

At present, there are in the world methods to lighten structures by including spherical or polyhedral-shaped coffers.

Among the methods known that include weight-lightening elements, one is the prefabricated slabs produced in factories. The prefabricated slabs are made up of a layer of reinforced concrete; over this concrete layer there is an iron mesh stretching along two directions; over this iron mesh it is placed a plurality of blown plastic spheres, and over said spheres it is placed a second two directions iron mesh.

A prior art construction which includes the use of said light-weight elements distributed along the reinforced concrete components is given by US2005/0138877 A1, applied by Mr. Inoue and Inokuchi. This prior art teaches the use of a lower concrete strata, over which it is placed a plurality of parallel lower bars 2*a*, 2*b*, forming a hole 4, through which passes said light-weight bodies 5 which may be hollow. Each one of said bodies 5 is retained in place by a corresponding plurality of saddles (6, 13, 15) extending downwards, being each one of said saddles welded to an upper plurality of reinforcing bars 3*a*, 3*b*. Said saddles can be regularly spaced, thus we have for a given plurality of saddles thus distributed a corresponding plurality of said bodies 5, each one of them retained in place by one of said saddles. Therefore this above said constructions requires a precise and costly welding of these saddles, once the bodies 5 have been placed on said lower concrete strata.

Another prior art construction is given by US2009/0165420 A1, to Pfeffer. This teaches a linear displacement of bodies 5, arranged adjacent the one to the other. Each body 5 is held in place by individual lattice work made of bars 3, 4. Each body 5 has two opposed polar depressions 9, eventually connected to its lateral surface by radial groves 11. Also in this construction, an extensive prior preparation is needed in order to weld the individual lateral saddles retaining in each pair of said saddles one of said bodies 5, which entails a heavy cost and man power.

Among the known methods including weight-lightening components, one is the prefabricated slabs produced in factories. Said prefabricated slabs are made up of a layer of reinforced concrete; over this layer is placed an iron mesh stretching along two directions. On said mesh it is placed a plurality of blown plastic hollow spheres, over which a second iron mesh in two directions is placed. Both meshes are welded to pyramidal three dimensional grid metal beams.

These prefabricated slabs are manufactured on a vibrating mould where in the site, a layer of concrete is poured where the compound comprising the metal beams and the spheres are then dipped by means of a crane. Thus, using specialized machinery, pressure and vibration are simultaneously exerted on the spheres, submerging them into the fresh concrete. Once the concrete hardens, the elements are stacked up until attaining the thickness required by the slab, and then subsequently transported to the construction site. This method generates relevant transport expenses and requires large warehouse space in the construction site. Once in the construction site, moreover, the weight of these pieces demands large capacity cranes in order to mount them in the construction. Once the pieces are positioned in their final location, the second concrete filling stage is carried out.

Another existing method consists of a three dimensional iron cage instead of the meshes containing the spheres, namely, a three dimensional trapezoidal beam which contains the aligned spheres in its interior. The slab is formed by placing these beams parallel to each other. The iron bars are placed in both directions on the beams, then to be filled with concrete.

In these two last described prior art it may be appreciated that the largest inconvenience is that of the relevant cost involved in transporting trapped air and heavy pre-cast structures, since the slabs and the pre-cast slabs are already given their final size before being mounted into their final place of destination. This demands large capacity means of transportation and cranes, as well as heavy investment in centralized factories, while in the first two named prior art patents the spheres must be placed into individual holes defined by two parallel lattice work or stirrups which must be individually welded to the supporting irons, thus rendering their construction process cumbersome and specifically with very high cost due to the extensive use of man power.

The present invention provides a solution to the problems of lightening the structures by providing a concrete structure comprising weight-lightening discs that includes a compound consisting of weight-lightening discs and electro-welded meshes, and hooks to hold together these meshes, which are specifically designed for each particular thickness of the slabs and their resistance to the applied forces, and a method of construction. Moreover, the set of discs allows lightening the weight of minimum thickness slabs. In fact, if spheres of a diameter equal to the height of the disc should be used, this would require the use of a large quantity of spheres and therefore double the work of assembly of the spheres and require the use of too dense a mesh. Furthermore, an excessive quantity of iron and of material of the spheres would be needed, in addition to the difficulty of pouring concrete in much reduced spaces. As regards traditional constructive methods, an excessive consumption of reinforced concrete and of steel frames may be observed, with the resulting increase of waste and man hours and, consequently, larger construction costs and time.

The object of the present invention is to provide a new concrete structure and a method for constructing very light reinforced concrete structures, in which the weight-lightening discs allows making slabs and prefabricated slabs of minimum thickness, optimizing materials and costs, which has not been accomplished by any of the prior art. Furthermore, this method has the advantage of being environment-friendly, crucial in a scenario of changing climate, where the construction sector is responsible for producing 40% of the $CO_2$ pollution in the planet. This method allows saving concrete and steel, building with progressively lighter structures and using recyclable plastic materials. Moreover, this method contributes to the reduction of 220 tns. of $CO_2$ for each 10000 $m^2$ built and 1000 $m^3$ of reinforced concrete.

Besides, it is possible to build on expansive clay soils and on flood-prone areas, which are alarmingly extending as a result of the climate changes and the rising of the water level. In effect, the seismic resistance of the accomplished structures increases by 30% approximately because of the reduction of the weight of the structures. In addition, this method allows building larger floor surfaces free from beams and with fewer columns, which provides a larger flexibility for the use of the buildings and allows changing their function over time.

The reduced energy costs resulting from the high thermal insulation of the slabs and the walls built with the weight-lightening discs may be combined with a system of sun-screens with large cantilevers to allow the passage of the sun in winter and prevent the passage of the sun rays inside the building in summer making this method a sustainable system.

The innovation of this patent is centered in the structures of reinforced concrete lightened by means of weight-reducing discs, which allows making thinner slabs, thus saving significant quantities of concrete and steel. In effect, these slabs are much lighter than the solid slabs and also more resistant. Another advantage of this innovation is the reduction of the load transmitted to the ground, the reduction if the cost of the foundations, columns and bearing walls in buildings.

DETAILED DESCRIPTION OF THE INVENTION

Figure 1:
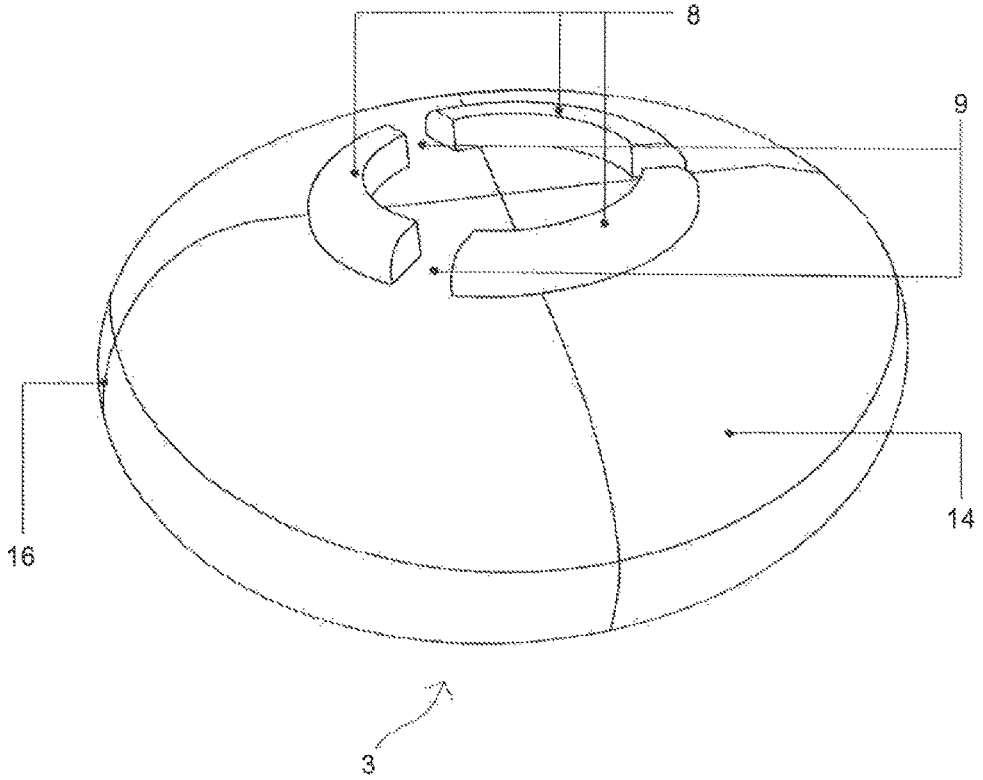
FIG. 1: An overview of a construction of a weight-reducing disc used in this invention.
Figure 2:
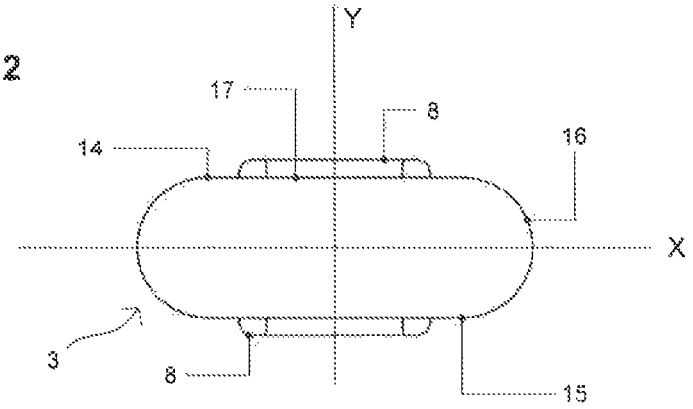
FIG. 2: A side view of the weight-lightening disc according to FIG. 1.
Figure 3:
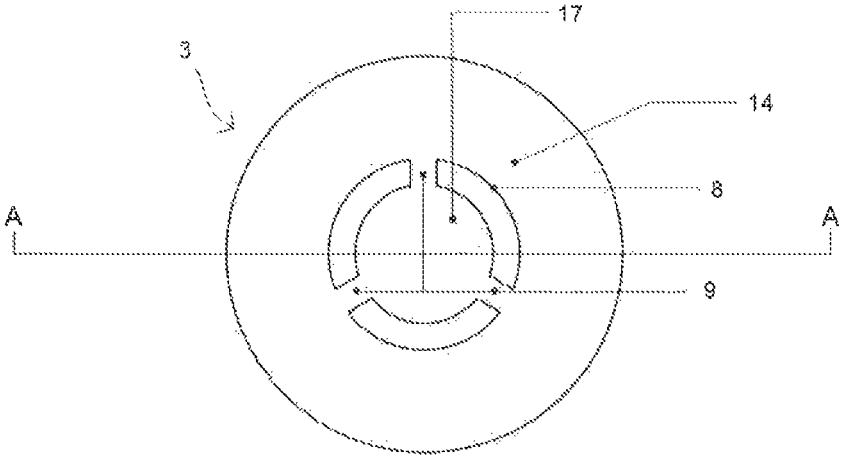
FIG. 3: Top view of the embodiment of FIG. 1
Figure 4:
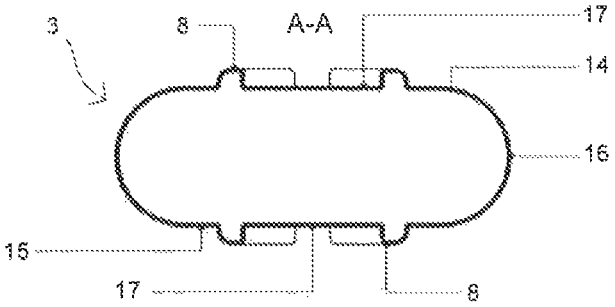
FIG. 4: Sectional view of the weight-lightening disc of FIG. 1

FIG. 1 (overview in line), FIG. 2 (view), FIG. 3 (top view) and FIG. 4 (sectional view) show one embodiment of a weight-lightening disc according to this instant invention, this being a hollow revolution body volume, flattened along its Y axis, with flat upper and lower faces and curved sides.

The weight-lightening disc according to this invention is symmetrical with respect to its X axis, as shown in FIG. 2, which X axis divides the disc horizontally.

The disc has added volume projecting from its upper and lower faces. These projections, in all the embodiments according to FIG. 1, 14 to 25, are inscribed within a circle. Making specific reference to this first embodiment shown in FIG. 1 to 4, these projections are shaped as a ring (8) (FIG. 3).

The thus inscribed with in a circle projections fits snuggly into the mesh grid holes without the need of purposely arranging this part into any specifically defined position, thus expediting the work of construction. By being symmetrical, the disc can be placed in the mesh on any of its two sides, which also facilitates and expedites the works.

The ample bend radius of the disc sides allows optimal concreting, and the concrete can easily reach the bottom.

In the first embodiment of the disc according to this invention, (FIG. 1 to 4) the projection (8) is an annulus with three radial slots (9) (FIG. 3) of such size that the iron parts of the mesh may in no way pass into them, which prevents any type of mistake in the placing of the discs on the meshes. Also said annulus can made without slots (9).

The disc of this invention may have different proportions, dimensions of its Y or X axes or of its bend radius As regards the manufacturing method of the disc, it may be made by blown-molding, roto-molding, as well as by injection or thermoforming (in two fitting parts thereof), while the material employed can be virgin or recycled material, preferably thermoplastic material.

Figure 5:
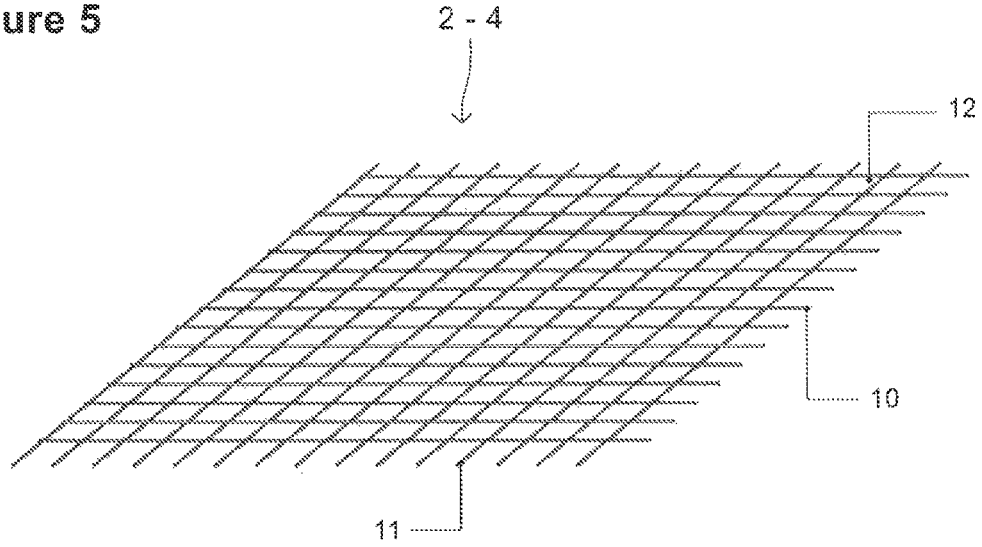
FIG. 5: Overview of the specially designed mesh formed by specially designed mesh formed by welded or tied bars, having protruding bars in two of its adjoining sides.

The meshes, are specifically designed for this method, with the particular characteristic of having protruding bars (10, 11) on two of their sides (FIG. 5). This provides a solution to the technical problem of joining adjacent meshes and at the same time keeping the same thicknesses, and also helps save material that would otherwise be needed for the joints.

The upper and lower meshes are joined together exerting the one towards the other by any known means, such as tensioning elements or tumbuckles, specially designed for each thickness of the slab, so as to articulate and hold together the compound made up by the meshes and the discs placed in between, and to attach thereof to the framework, thus preventing the discs from floating when pouring the concrete.

A factor of paramount importance for this invention is the grid value or dimension of the hole (12) in the mesh. In a preferred embodiment, said holes (12) are equal sized squares and the holes (12) of the lower mesh (2) are equal to the holes (12) of the upper mesh. At the same time the circumference (13) of the projections has a diameter slightly lower that said squares (12) thus enabling said projections such as (8) to fit snugly into said openings (12). This allows placing the discs which will be retained in place by both meshes when same are joined together.

The invention also includes a method of construction which in turn, includes a method for slabs and a method for pre-fabricated slabs.

Figure 6:
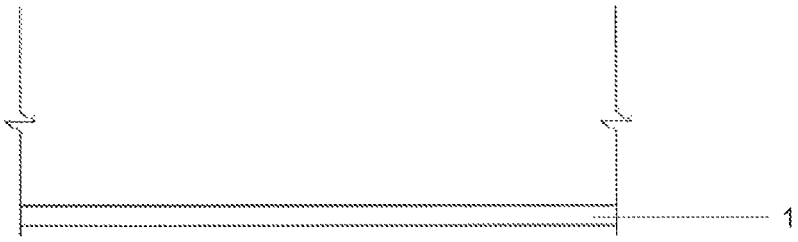
FIG. 6: View of the first stage of the construction process for construction of the slab: Placing of the traditional formwork (1).
Figure 7:
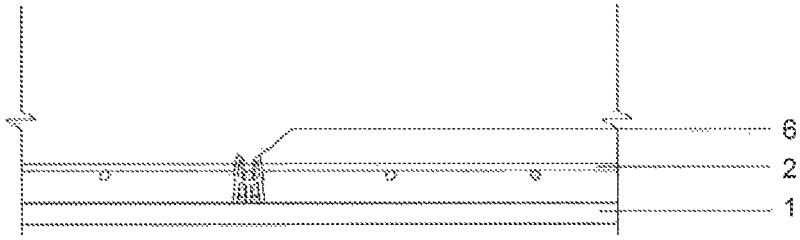
FIG. 7: View of the second stage of the construction process for construction of the slab: Placing of the lower steel mesh (2) separated from the bottom by means of spacers (6), such as plastic spacers.

The slab-method consists of the following steps:

Placing the traditional formwork (1); (FIG. 6);

Placing the lower steel mesh (2), separated from the bottom by means of plastic spacers (6); (FIG. 7).

Figure 8:
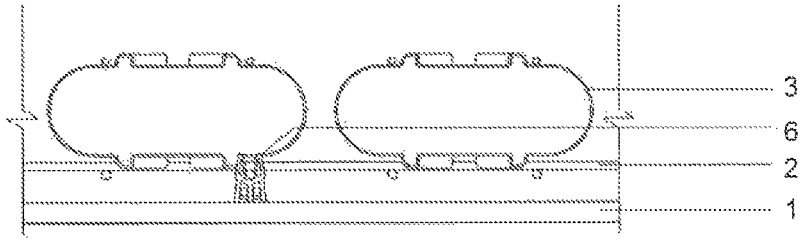
FIG. 8: View of the third stage of the construction process for construction of the slab: Placing of the weight-lightening discs (3).

Placing the weight lightening discs (3) fitting the lower projections (8) into the grid holes (12) of the lower mesh (2); (FIG. 8).

Figure 9:
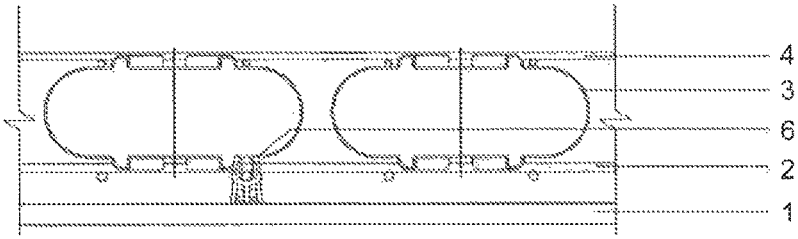
FIG. 9: View over the fourth stage of the construction process for construction of the slab: Placing of the upper steel mesh (4).

Placing the upper steel mesh (4), fitting the upper projections (8) into said grid holes (12); (FIG. 9).

Figure 10:
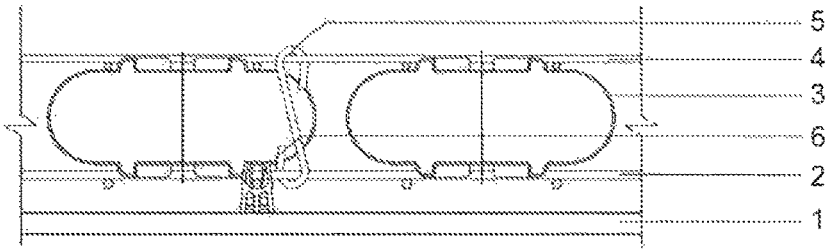
FIG. 10: View over the fifth stage of the construction process for construction of a slab. Both meshes are attached be means of hooks (5), retaining in between the plurality of discs (3).

Attaching the two meshes (2, 4) by means of said hooks (5) or tumbuckles (not shown); (FIG. 10).

Figure 11:
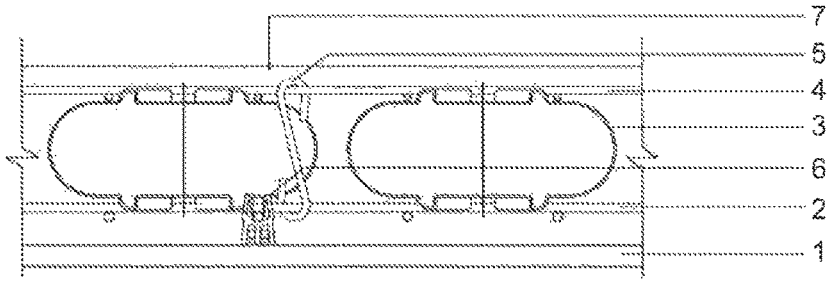
FIG. 11: View over a sixth stage of the construction process for construction of a slab: Pouring of concrete (7).

Pouring the concrete (7); (FIG. 11).

Figure 12:
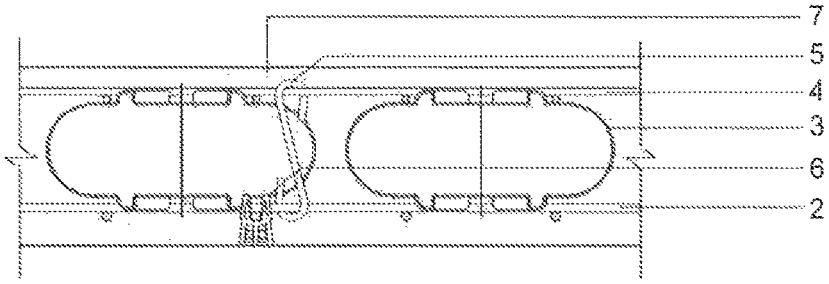
FIG. 12: View over the seventh stage of the construction process for construction of a slab: Removal of formwork.
Figure 13:
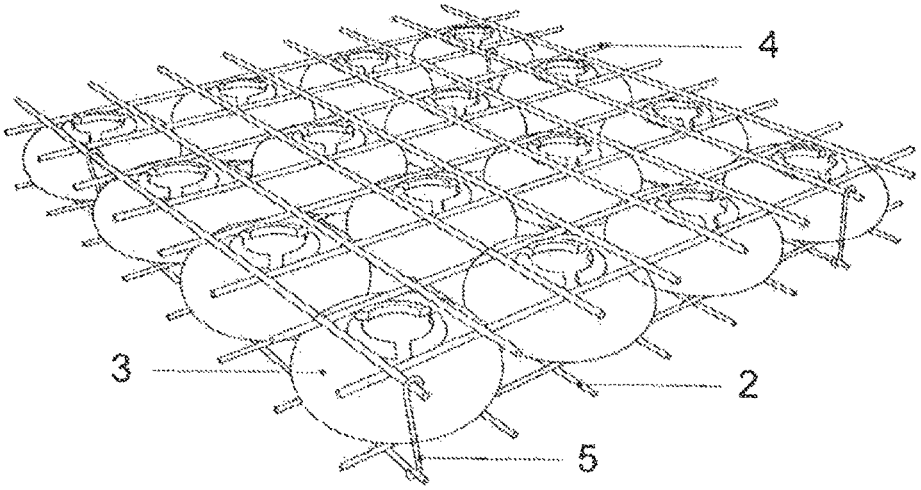
FIG. 13: Overview of the compound made up by the meshes, the weight-lightening discs and the tumbuckles.

Removal of framework; (FIG. 12).

The prefabricated slab method consists of the following steps:

Preparing the molding plate;

Placing the lower steel mesh (2), separated from the bottom by means of plastic spacers (6);

Placing the weight lightening discs (3) fitting the lower projections (8) into the grid holes (12) of the lower mesh (2);

Placing the upper steel mesh (4), fitting the upper projections (8) into said grid holes (12);

Attaching the two meshes (2, 4) by means of said hooks (5) or tumbuckles;

Pouring a first layer of concrete until reaching a height equivalent to the mid-section of said discs;

Assembly of the prefabricated slab in its final location;

Final concreting as per FIG. 11;

Removal of formwork.

The following elements make up the system that is the object of this instant patent:

The compound formed by the slab and the weight-lightening discs includes two metal meshes (2, 4) that enclose the plurality of discs (3), which discs have a flattened upper and lower faces with protruding projections which volume is inscribed within a circumference (13) that fits into de square spaces or holes (12) of said mesh (2, 4).

The meshes are held together by means of tensioning elements or tumbuckles that either have an upper and a lower fold with the shape of a hook (5) as shown in FIG. 10 or an upper and a lower shackle (not shown) which attach the compound of elements to formwork where the lightened slabs will be filled. The hooks (5) prevent the discs from floating.

The meshes are specifically designed for this method and have protruding bars (10, 11) on two of their sides as shown in FIG. 5. This is, on the one hand, in order to provide a solution to the technical problem of the joints along the meshes while keeping the desired thickness, and on the other hand, as a means of saving material that would be otherwise needed for these joints.

The meshes may be manufactured into ready-made modules formed by welded bars (FIG. 5) delivered straight to the construction site, or may be assembled by bars in the construction site by tying them with wire, or else, already rolled mesh can be used.

If the slabs thus lightened by weight-reducing disc is used as foundations there are two variants. The first variant is that of using the slab as a foundation slab directly affixed to the ground. The second variant is that of a slab supported by reinforced concrete piles drilled into the ground. In this last case, to counter the effect of expansive clay, which could fracture a floor built in this manner, honeycomb is used, either made of paper or of recycled plastic bags, wrapped up in polythene to prevent the softening effect of humidity in the first days. The mesh with the discs is placed above this cardboard platform and the foundation slab is concreted together with the plies.

If the soil where to slab is grounded is expansive clay, after some days the cardboard platform will soften by effect of the moisture of the soil and the clay will be able to expand freely, without pushing the foundation slab.

As regards cover or roof slabs lightened by the discs, these slabs have a drainage slope and are kept covered by water during seven days being made fully water-proof by the inclusion in this mass of a chemical product that seals the concrete where the water penetrates through the smallest hair crack. In effect a process similar to that of nanotechnology occurs by virtue of an expansion of the salts contained in the chemical product, which immediately seals any hair-cracks thus preventing the passage of water.

The weight-lightening discs (3) are placed on the holes (12) or grid of the lower mesh (2) inserting the projections (8) with said holes, which fits into the grid of the mesh without the need of arranging said discs into any particular position. This speeds up the construction work and prevents possible mistakes. Since said discs are symmetrical in their Y axis (FIG. 2), the discs can be places into said mesh on any of its two sides (14, 15) (FIG. 2), additionally facilitating the task. The ample bend radium of the sides (16) allows optimal concreting easily reaching he lower sections.

After this, the upper mesh (4) is placed on the upper surface (14) of the discs, fitting the projections (8) into the grid of said upper mesh, performing the laying of this upper mesh with minimum waste and maximum assembly speed.

Then, the lower mesh (2) and the upper mesh (4) are fixed together by means of hooks (5) or the like. These hooks can be zigzag stirrups or butcher hooks which articulate and holds together the upper and lower meshes.

When this is accomplished, with the eventual fixing of said compound to the lower formwork (1), (FIG: 6 and FIG. 7), the concreting proceeds. Thanks to the ample bend radium of the disc sides (16), an optimal concreting may be accomplished by the concrete easily filling the lower sections. In the embodiment of FIGS. 1 to 4, the ring-shaped upper and lower projections (8) of the disc has three interruptions (9), allowing the entrance of the concrete and the filling of the central section (17) of the disc.

Figure 15:
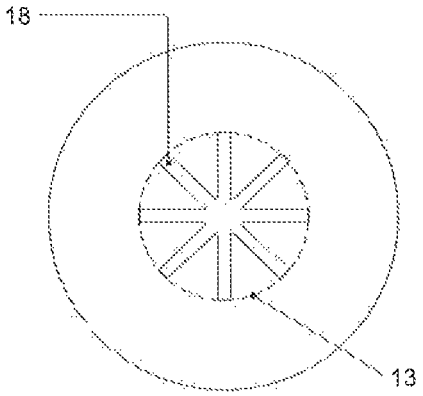
FIG. 15: An overview of the weight-reducing disc according to the embodiment in FIG. 14.
Figure 14:
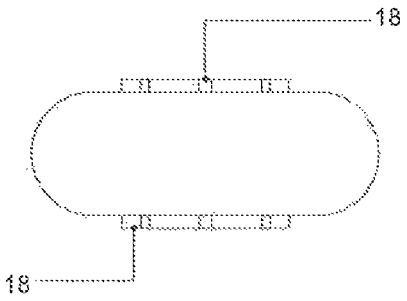
FIG. 14: A side view of the weight-lightening disc according to a second embodiment of this invention.

FIG. 14 depicts a side view of weight-lightening disc of this invention according to a second embodiment thereof, wherein the projection instead of the annulus (8) is a eight arms cross inscribed within a circle (13), and FIG. 15 shows a overview of this second embodiment.

Figure 17:
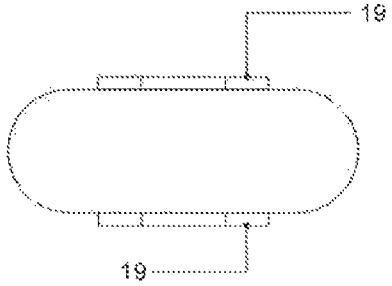
FIG. 17: A side view of the weight-lightening disc according to the third embodiment of this invention.
Figure 16:
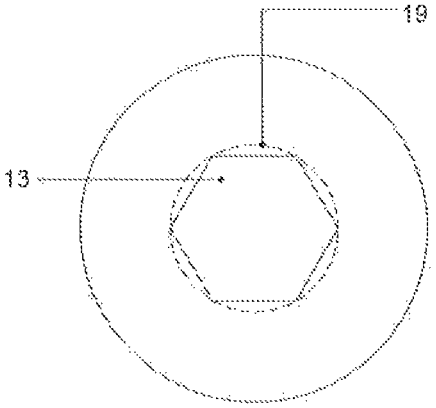
FIG. 16: An overview of the weight-reducing disc according to a third embodiment of this invention.

FIG. 16 is an overview of a third embodiment of the disc of this invention wherein the projecting volume is an hexagon (19) inscribed within a circle (13), and FIG. 17 is its side view.

Figure 18:
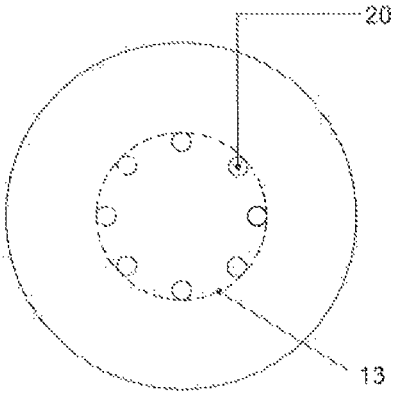
FIG. 18: An overview of the weight-reducing disc according to a fourth embodiment of this invention.
Figure 19:
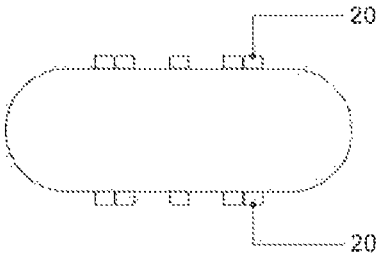
FIG. 19: A side view of the weight-lightening disc according to the fourth embodiment of this invention.

FIG. 18 is an overview of a fourth embodiment of the disc of this invention wherein the salient volume is a plurality of small cylindrical projections (20) distributed crown-wise around a circle (13), and FIG. 19 is its side view.

Figure 20:
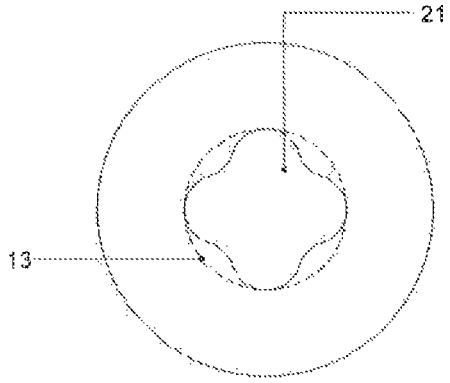
FIG. 20: An overview of the weight-reducing disc according to a fifth embodiment of this invention.
Figure 21:
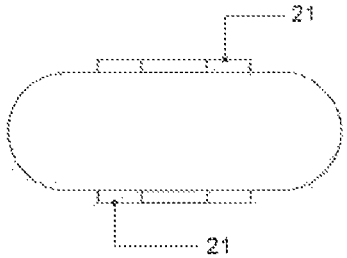
FIG. 21: A side view of the weight-lightening disc according to the fifth embodiment of this invention.

FIG. 20 is an overview of a fifth embodiment of the disc of this invention wherein the salient volume is a lobular projection (21) inscribed within a circle (13) and FIG. 21 is its side view.

Figure 22:
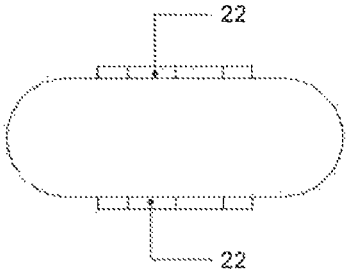
FIG. 22: A side view of the weight-lightening disc according to a sixth embodiment of this invention.
Figure 23:
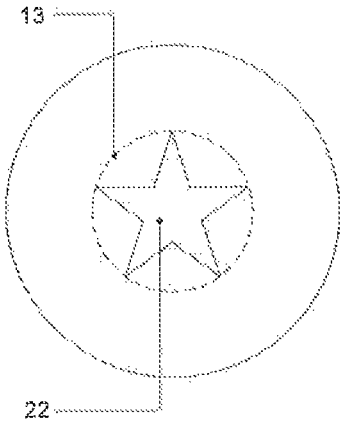
FIG. 23: An overview of the weight-reducing disc according to the sixth embodiment of this invention.

FIG. 22 is a side view of a sixth embodiment of the disc of this invention wherein the salient volume is a five point star projection (22) inscribed within a circle (13) and FIG. 23 is its overview.

Figure 24:
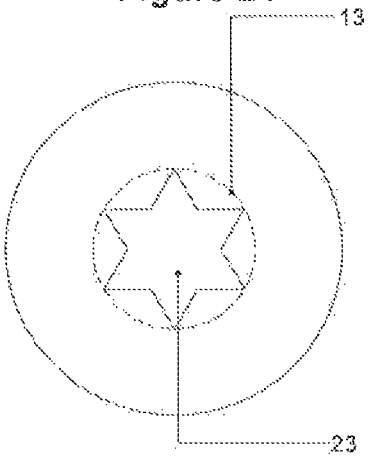
FIG. 24: An overview of the weight-reducing disc according to a seventh embodiment of this invention.
Figure 25:
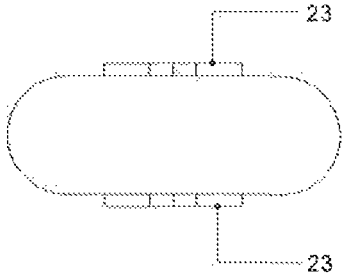
FIG. 25: A side view of the weight-lightening disc according to the seventh embodiment of this invention.

FIG. 24 is an overview of a seventh embodiment of the disc of this invention wherein the salient volume is a six-point star (23) inscribed within a circle (13) and FIG. 25 is its side view.

The invention claimed is:

1. A reinforced concrete structure comprising:

an upper mesh and a lower mesh;

at least one weight-lightening disc that includes a body forming a hollow volume, the body having a spherical shape defined by an X axis and a Y axis that is perpendicular to the X axis, wherein the body is flattened along the Y axis and forms upper and lower flattened faces and curved sides that are symmetrical about the X axis;

the body forming an additional volume at the lower and upper flattened faces projecting outwardly from said faces, the additional volumes inscribed within a circle and configured to provide immobilization and engagement of the body when the body is disposed between the upper mesh and the lower mesh, wherein each of the upper and lower meshes is constructed by arranging two sets of parallel steel bars into a grid that includes holes formed between the two sets of parallel steel bars, wherein the additional projecting volume inscribed within the circle is sufficiently sized to fit into and engage the holes in the mesh thus preventing displacement of the body when the additional volume engages the respective hole in the upper mesh and the lower mesh;

tensioning elements holding together both upper and lower mesh imprisoning in between said at least one weight-lightening disc; and concrete filling and covering said upper and lower mesh and covering the hollow volume of said at least one weight-lightening disc.

2. A reinforced concrete structure according to claim 1, wherein in said weight-lightening disc the dimension and profile of the additional upper projecting volume inscribed within a circle is similar to the additional lower projecting volume inscribed within a circle.

3. A reinforced concrete structure according to claim 1, wherein the holes in the upper mesh are similar to the holes in the lower mesh.

4. A reinforced concrete structure according to claim 1, wherein the dimensions of the body along the Y axis and the X axes and a radius of curvature of the curved sides varies along the body.

5. A reinforced concrete structure according to claim 1, wherein the profile of the additional projecting volume inscribed within a circle is chosen within an annulus, a hexagon, a five and six pointed star, a lobular figure, a cross and a plurality of small cylindrical projections.

6. A reinforced concrete structure according to claim 5, wherein an upper and lower projecting annulus has at least one slot communicating with an inner volume of said annulus with the external surfaces of said weight-lightening disc.

7. A construction method for making light reinforced concrete structures including slabs, prefabricated slabs, foundation slabs, partition walls and beams, which includes weight-lightening discs and a mesh, the method comprising:

a) placing at least one of formworks and molding tracks;

b) placing on the one of the formworks and molding tracks lower meshes designed with protruding bars in two directions, wherein the bars are at least one of electro-welded, tied with wire, and modular, the lower meshes forming a grid that includes a plurality of openings between bars defined in the lower mesh;

c) placing and fitting weight-lightening discs in the grid of the lower meshes;

d) placing upper meshes designed with protruding bars in two directions onto the upper faces of the discs, the upper meshes forming a grid that includes a plurality of holes between bars defined in the upper mesh being aligned with the holes in the lower mesh, wherein each of the upper and lower meshes is constructed by arranging two sets of parallel steel bars into a grid that includes the holes formed between the two sets of parallel steel bars, wherein the discs are immobilized and positioned between the grid of the lower meshes and the grid of the upper meshes in a correct position by additional volumes inscribed with a circle projecting from the upper and lower faces of the discs, the additional volumes fitting into and engaging the holes in the upper and lower meshes; and e) attaching the upper and the lower meshes by connecting elements in preparation for a concreting operation; and f) pouring concrete until the upper mesh is conveniently covered.

8. A construction method according to claim 7, wherein concreting comprises pouring concrete in two stages.

* * * * *